US010851767B2

(12) United States Patent
Aritomi et al.

(10) Patent No.: US 10,851,767 B2
(45) Date of Patent: Dec. 1, 2020

(54) PUMP FOR SUPPLYING HIGH-PRESSURE FUEL

(71) Applicant: Hitachi Automotive Systems, Ltd., Hitachinaka (JP)

(72) Inventors: Shunsuke Aritomi, Tokyo (JP); Kenichirou Tokuo, Tokyo (JP); Satoshi Usui, Hitachinaka (JP); Shingo Tamura, Hitachinaka (JP)

(73) Assignee: Hitachi Automotive Systems, Ltd., Hitachinaka (JP)

( * ) Notice: Subject to any disclaimer, the term of this patent is extended or adjusted under 35 U.S.C. 154(b) by 0 days.

(21) Appl. No.: 16/238,807

(22) Filed: Jan. 3, 2019

(65) Prior Publication Data

US 2019/0136841 A1 May 9, 2019

Related U.S. Application Data

(63) Continuation of application No. 14/439,419, filed as application No. PCT/JP2013/077409 on Oct. 9, 2013, now abandoned.

(30) Foreign Application Priority Data

Oct. 31, 2012 (JP) ..... 2012-239738

(51) Int. Cl.
*F04B 19/22* (2006.01)
*F02M 59/10* (2006.01)
(Continued)

(52) U.S. Cl.
CPC ..... *F04B 19/22* (2013.01); *F02M 59/102* (2013.01); *F02M 59/442* (2013.01); *F04B 1/0421* (2013.01); *F04B 1/0448* (2013.01)

(58) Field of Classification Search
CPC ..... F04B 1/0448; F04B 1/0421; F04B 19/22; F04B 53/16; F02B 59/102; F02B 59/442;
(Continued)

(56) References Cited

U.S. PATENT DOCUMENTS 5,957,674 A * 9/1999 Zenmei ..... F02M 59/366 123/446
6,446,604 B1 * 9/2002 Guentert ..... F02M 59/06 123/456
(Continued)

FOREIGN PATENT DOCUMENTS

DE 103 22 595 A1 12/2004
JP 62-93162 U 6/1987
(Continued)

OTHER PUBLICATIONS

International Search Report (PCT/ISA/210) dated Nov. 26, 2013 with English translation (five pages).
(Continued)

*Primary Examiner* — Dustin T Nguyen
(74) *Attorney, Agent, or Firm* — Crowell & Moring LLP

(57) ABSTRACT

A pump for supplying high-pressure includes a plunger, a cylinder, a body, and a holder. The uppermost end surface of the cylinder is an end of the cylinder that is closest to the pressurizing chamber. A first gap formed between the outer periphery of the cylinder and the body in the radial direction is smaller than a second gap formed in the radial direction between the inner diameter of the pressurizing chamber and the outer diameter of the plunger. A radial gap is formed in an entire area of the cylinder in an axial direction thereof.

16 Claims, 6 Drawing Sheets

(51) Int. Cl.

| | |
|---|---|
| ***F02M 59/44*** | (2006.01) |
| ***F04B 1/0421*** | (2020.01) |
| ***F04B 1/0448*** | (2020.01) |

(58) Field of Classification Search

CPC ..... F02B 59/32; F16J 10/04; F02M 59/102; F02M 59/44; F02M 59/442; F02M 59/48; F02M 63/0225

USPC ..... 92/169.1, 169.4, 259

See application file for complete search history.

(56) References Cited

U.S. PATENT DOCUMENTS

| | | | | |
|---|---|---|---|---|
| 6,860,255 | B2 | 3/2005 | Yamaguchi et al. | |
| 6,991,438 | B2 * | 1/2006 | Blessing | F04B 1/0426 417/273 |
| 7,707,996 | B2 | 5/2010 | Yamada et al. | |
| 2004/0052652 | A1 | 3/2004 | Yamada et al. | |
| 2011/0247488 | A1 | 10/2011 | Oikawa | |
| 2011/0303195 | A1 * | 12/2011 | Lucas | F02M 59/102 123/495 |
| 2012/0012084 | A1 | 1/2012 | Petrone et al. | |
| 2012/0093670 | A1 | 4/2012 | Usui et al. | |
| 2020/0049117 | A1 * | 2/2020 | Asayama | F02M 59/02 |

FOREIGN PATENT DOCUMENTS

| | | | | | |
|---|---|---|---|---|---|
| JP | 9-250427 | A | | 9/1997 | |
| JP | 2001-50174 | A | | 2/2001 | |
| JP | 2001050174 | | * | 2/2001 | F02M 47/00 |
| JP | 2003-148294 | A | | 5/2003 | |
| JP | 2008-64013 | A | | 3/2008 | |
| JP | 4006336 | B2 | | 11/2008 | |
| JP | 2009-185613 | A | | 8/2009 | |
| JP | 2010-106741 | A | | 5/2010 | |
| JP | 2011-231458 | A | | 11/2011 | |
| JP | 2011-231758 | A | | 11/2011 | |
| JP | 2012-82810 | A | | 4/2012 | |
| JP | 2012-82849 | A | | 4/2012 | |
| JP | 2012-202375 | A | | 10/2012 | |
| WO | WO 00/47888 | A1 | | 8/2000 | |

OTHER PUBLICATIONS

Japanese-language Office Action issued in counterpart Japanese Application No. 2012-239738 dated Feb. 9, 2016 with English translation (11 pages).

Japanese-language Office Action issued in counterpart Japanese Application No. 2012-239738 dated Jul. 5, 2016 with English translation (6 pages).

European Office Action issued in counterpart European Application No. 13 850 845.2 dated Sep. 28, 2018 (four (4) pages).

* cited by examiner

PUMP FOR SUPPLYING HIGH-PRESSURE FUEL

CROSS REFERENCE TO RELATED APPLICATIONS

This application is a continuation of U.S. application Ser. No. 14/439,419, filed Apr. 29, 2015, which is a 371 of International Application No. PCT/JP2013/077409, filed Oct. 9, 2013, which claims priority from Japanese Patent Application No. 2012-239738, filed Oct. 31, 2017, the disclosures of which are expressly incorporated by reference herein.

TECHNICAL FIELD

The present invention relates to a pump for supplying high-pressure fuel which supplies a fuel at high-pressure to an internal combustion engine.

BACKGROUND ART

Reduction in size, higher output, and higher efficiency of internal combustion engines have been energetically achieved these days. To this end, the pumps for supplying high-pressure fuel are strongly required to have smaller bodies to improve the mountablity into internal combustion engines, and increased flow rates and higher pressures of discharged fuel to cope with higher output and efficiency. In particular, achieving higher discharge pressure is drawing attention as one of the measures to cope with the emission requirement which grows stricter year by year.

Various methods for forming a sliding portion of the pump for supplying high-pressure fuel have been suggested. Among them, the simplification of the structure and a reduction in production costs are significant objects. In a pump for supplying high-pressure fuel, a plunger reciprocates to pressurize the fuel in the pressurizing chamber, and therefore the inner wall face of the cylinder which guides the reciprocating movement of the plunger and the external wall face of the plunger serve as sliding portions.

In Patent Literature 1, a cylinder which is formed by a separate component from a body is provided as a wall for guiding the plunger. The patent document discloses a method for fixing the cylinder by pressing the cylinder into the body, forming a low-pressure fuel portion on the outer periphery of the sliding portion which slides against the plunger and cooling the sliding portion.

Patent Literature 2 discloses a method for fixing the cylinder which is formed as a separate member from the body by holding the cylinder between the body and a holder member.

CITATION LIST

Patent Literature

PTL 1: Japanese Unexamined Patent Publication No. 2011-231458

PTL 2: Japanese Unexamined Patent Publication No. 2010-106741

SUMMARY OF INVENTION

Technical Problem

When the cylinder which guides the reciprocating movement of the plunger is formed as a separate member from the body, it is necessary to secure this cylinder to the body. When an external force is applied from the outside to the outer peripheral side face of the cylinder, the cylinder may be deformed and part or all of the inner peripheral side face (inner wall face) of the cylinder may contract. Since the cylinder guides the reciprocating movement of the plunger, it is necessary that the inner peripheral surface of the cylinder and the outer peripheral surface of the plunger form a sliding portion, ensuring a predetermined gap (clearance). If this gap is too large, fuel leakage from the pressurizing chamber increases and prevents sufficient pressurization, while too small a gap causes excessive frictional resistance in the sliding portion. Therefore, the gap in the sliding portion must be precisely managed.

If part or all of the inner peripheral surface of the cylinder contracts, the clearance of the sliding portion is reduced, and the frictional resistance increases. If the plunger repeats reciprocation in the cylinder in this state, the sliding portion may generate heat, and its reliability as the pump may be lost.

The external force applied from the outside to the cylinder occurs, for example, when the cylinder is pressed into the body in fixing the cylinder. Further, the pressure generated by the fuel pressurized in the pressurizing chamber acts on the outer periphery of the cylinder, and acts as an external force which contracts part or all of the inner diameter of the cylinder.

An object of the present invention is to propose a structure which is capable of suppressing deformation of the sliding portion, and to provide a highly reliable high-pressure fuel pump.

Solution to Problem

The invention is a pump for supplying high-pressure fuel including a plunger for pressurizing a fuel in a pressurizing chamber, a cylinder which guides the reciprocating movement of the plunger on an inner peripheral side face thereof, a body on which the cylinder is arranged, and a holder member which fixes the cylinder to the body by urging the cylinder in the axial direction, characterized in that a sealing portion is formed by pressing an end of the cylinder on the pressurizing chamber side against the body.

Advantageous Effects of Invention

According to the present invention configured as described above, the following effects are obtained.

A sealing portion formed by press-fitting the cylinder and the body prevents the fuel pressurized in the pressurizing chamber from leaking to the outer peripheral side face of the cylinder, and therefore the pressure of the pressurized fuel in the outer peripheral side face of the cylinder does not act as an external force to tighten the cylinder. Further, since the cylinder is fixed to the body by the holder member, an external force to tighten the cylinder when the cylinder is pressed into the body does not work. Therefore, the deformation of the inner peripheral side face of the cylinder, which is a sliding portion between the cylinder and the plunger, can be suppressed, and the reliability of the pump for supplying high-pressure fuel can be increased.

DESCRIPTION OF EMBODIMENTS

Embodiments of the present invention will be described below with reference to the drawings.

First Embodiment

Figure 1:
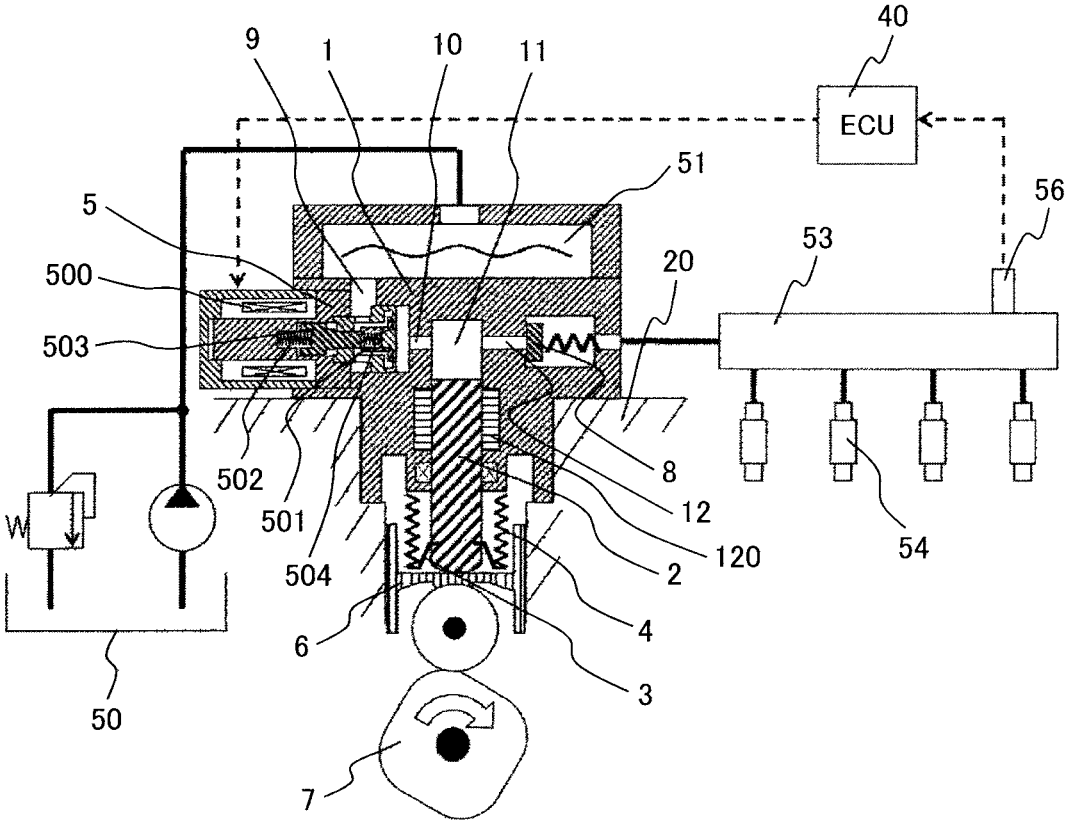
FIG. 1 shows the overall constitution of a system for carrying out first to third embodiments.

FIG. 1 shows the overall constitution of a system for carrying out first to third embodiments. A pump for supplying high-pressure fuel integrally incorporates a plurality of parts and mechanisms in a body 1, and is attached to a cylinder head 20 of an internal combustion engine. In the body 1, a fuel suction passage 10, a pressurizing chamber 11, and a fuel discharge passage 12 are formed.

In the fuel suction passage 10 and fuel discharge passage 12, an electromagnetic valve 5 and a discharge valve 8 are provided, and the discharge valve 8 serves as a check valve to restrict the flow direction of the fuel.

A plunger 2 is slidably inserted into a cylinder 120, and a retainer 3 is attached to the lower end of the same. The urging force of a return spring 4 acts on the retainer 3 in the downward direction in FIG. 1. A tappet 6 reciprocates in the vertical direction in FIG. 1 by the rotation of a cam 7 of the internal combustion engine. The plunger 2 is displaced following the tappet 6, which changes the capacity of the pressurizing chamber 11 to allow pumping action.

Further, the electromagnetic valve 5 is held by the body 1, and an electromagnetic coil 500, an anchor 503, an anchor spring 502, and a valve spring 504 are disposed thereon. An urging force of the anchor spring 502 acts on a valve body 501 in the valve opening direction via the anchor 503, the urging force of the valve spring 504 also acts in the direction of closing the valve. Herein, the urging force of the anchor spring 502 is greater than that of the valve spring 504, when the electromagnetic coil 500 is turned off (not energized), the valve body 501 is in an open state. This system of the electromagnetic valve will be referred to as a normal open system since it is in the open state when the electromagnetic coil is turn off and is in the closed state when the coil is turned on. The description provided below will be based on a system using the normal open system electromagnetic valve, while on the other hand, the first to third embodiments can be similarly carried out based on a system using an electromagnetic valve system referred to as a normal closed system in which the operation is reversed, that is, the valve body 501 is in the closed state when the electromagnetic coil 500 is turned off (not energized).

Further, description will be provided hereinbelow based on the case where the valve body 501 and the anchor 503 are separate bodies, but the first to third embodiments can be similarly carried out based on the case where the components are integrally formed.

An injector 54 and a pressure sensor 56 are mounted on a common rail 53. The injector 54 is amounted to suit the number of cylinders of the engine, and injects fuel at the signals from an engine control unit (ECU40).

Operation in the above configuration will be described.

The state in which the plunger 2 is displaced downwardly in FIG. 1 by the rotation of the cam 7 of the internal combustion engine is referred to as a suction stroke, while the state in which the plunger is displaced upwardly is referred to as a compression stroke. In the suction stroke, the capacity of the pressurizing chamber 11 increases, and the fuel pressure therein is reduced. In this stroke, when the fuel pressure in the pressurizing chamber 11 becomes lower than that in the low-pressure passage 9, the valve body 501 opens, and fuel is drawn into the pressurizing chamber.

At this time, since the urging force of the anchor spring 504 acts on the valve body 501 via the anchor 503, even if the plunger 2 transitions from the suction stroke to the compression stroke, the valve body 501 still maintains the state of being open. Therefore, even in the compression stroke, the pressure in the pressurizing chamber 11 is kept as low as that in the low-pressure passage 9, and thus the discharge valve 8 cannot be opened, so that the fuel in the quantity that is equivalent to the decrease in the capacity of the pressurizing chamber 11 is returned to a damper chamber 51 side through the electromagnetic valve 5. This stroke will be referred to as return stroke.

When the electromagnetic coil 500 is energized in the return stroke, the magnetic attraction acts on the anchor 503, and the anchor 503 moves in the closing direction by overcoming the urging force of the spring anchor 502. Then, the valve 501 is closed by the urging force of the valve spring 504 and the difference in the fluid pressure of the returning fuel. Then, immediately thereafter, the fuel pressure in the pressurizing chamber 11 is increases as the plunger 2 elevates. The discharge valve 8 opens automatically accordingly, and the fuel is pumped to the common rail 53.

By using the electromagnetic valve 5 operating in the manner described above, the flow rate of discharge of the pump can be controlled by adjusting the timing for the electromagnetic coil 500 to be turned on.

Figure 2:
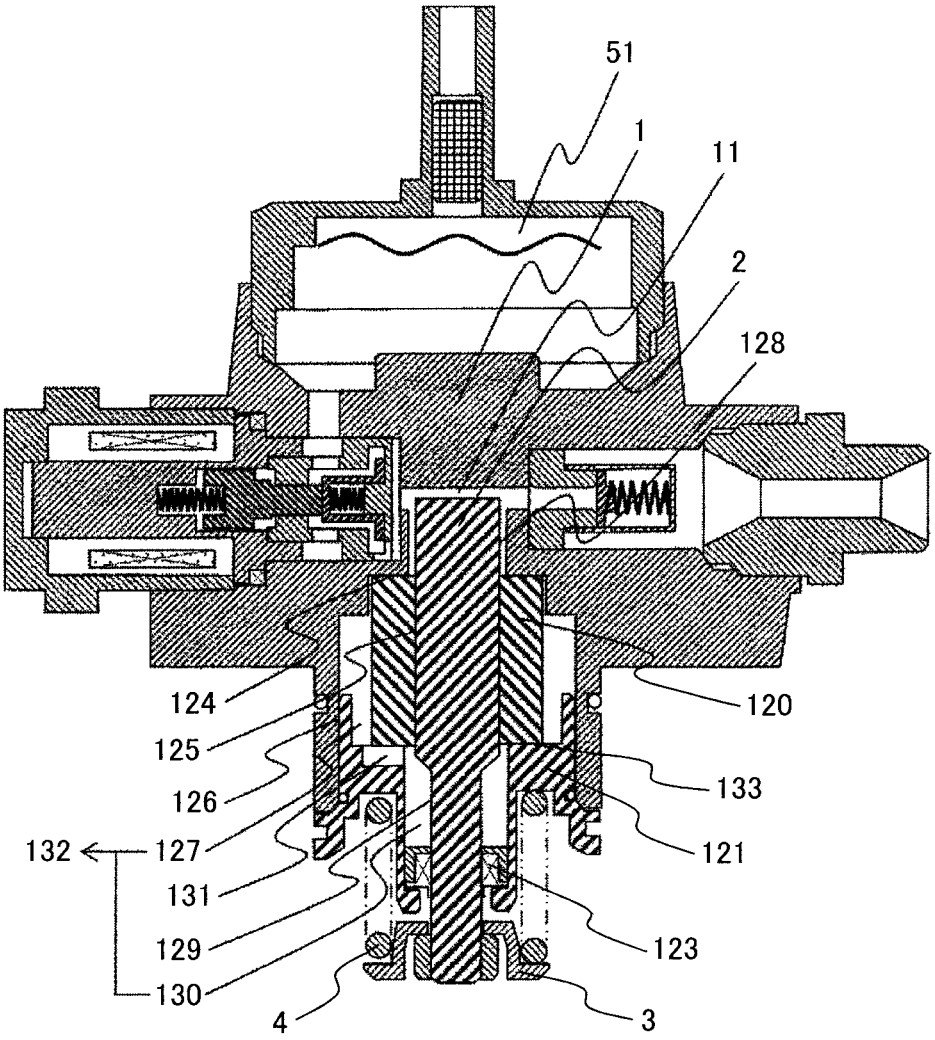
FIG. 2 shows a cross-sectional view of components around the cylinder (at top dead center) according to the first embodiment of the present invention.

FIG. 2 shows a cross-sectional view of components around the cylinder 120 according to the first embodiment of the present invention. It also shows the case where the plunger 2 is positioned at the top dead center. In FIG. 2, 1 represents a body, 2 a plunger, 120 a cylinder, 121 a holder member, 123 a sealing member, 4 a return spring, and 3 a retainer respectively. The holder member 121 is coupled to the body 1 via a coupling portion 126. The coupling portion 126 is formed by screw fastening, press-fitting, or welding. A holding unit 133, which is a part of the cylinder 120, is urged in the direction of the body 1 by the body holder 121, and a high-pressure sealing portion 124 is formed in the contact portion between the cylinder 120 and body 1. Herein, the pressurizing chamber 11 side of the high-pressure sealing portion 124 will be defined to as a high-pressure side, while the opposite side will be defined as a low-pressure side. A sliding portion 125 is provided on the low-pressure side of the high-pressure sealing portion 124 in the cylinder 120, and the plunger 2 is inserted into the cylinder 120 and supported by the sliding portion 125. Accordingly, the cylinder is not present in the pressurizing chamber, and therefore the pressure of the high-pressure fuel does not act on the cylinder and sliding portion, and deformation thereof can be suppressed. Further, since the cylinder 120 is fixed by the urging force in the axial direction with respect to the cylinder 120 and the high-pressure sealing portion 124 is formed, the deformation of the sliding portion 125 caused by an external force in fixing can be suppressed.

Further, a small-diameter portion 129 and a large-diameter portion 128 are provided on the plunger 2, and a low-pressure fuel portion 132, of which volume increases or decreases by the reciprocating movement of the same, is formed on the outer periphery thereof. The low-pressure fuel portion 132 is composed of a main low-pressure fuel portion 130 in contact with the plunger 2, and a secondary low-pressure fuel portion 127 formed on the outer periphery of the cylinder 120, both of which are connected to each other by a fuel passage slit 131. Further, the secondary low-pressure fuel portion 127 is connected to a damper chamber 51 by a damper chamber passage (not shown). By employing such a structure, with the reciprocation of the plunger 2, a reciprocating flow of fuel is generated between the low-pressure fuel section 132 and the damper chamber 51. Thus, such effects that pressure pulsation of the damper chamber 51 with the reciprocation of the plunger 2 can be reduced and that the friction heat generated at the sliding portion 125 can be dissipated into new incoming fuel can be expected.

The sealing member 123 is fixed to the holder member 121, and the plunger 2 is inserted at the center of the same. Accordingly, even when the plunger 2 makes a reciprocating movement, the fuel does not leak from the low-pressure fuel portion 132 to the outside.

In summary, according to the present embodiment, the discharge pressure and the external force in fixing do not act on the outer periphery of the cylinder 120, and therefore even when the discharge pressure is increased to a high level, deformation of the cylinder 120 and the sliding portion 125 formed therein can be prevented, and the reliability of the sliding portion 125 can be increased.

Second Embodiment

Figure 3:
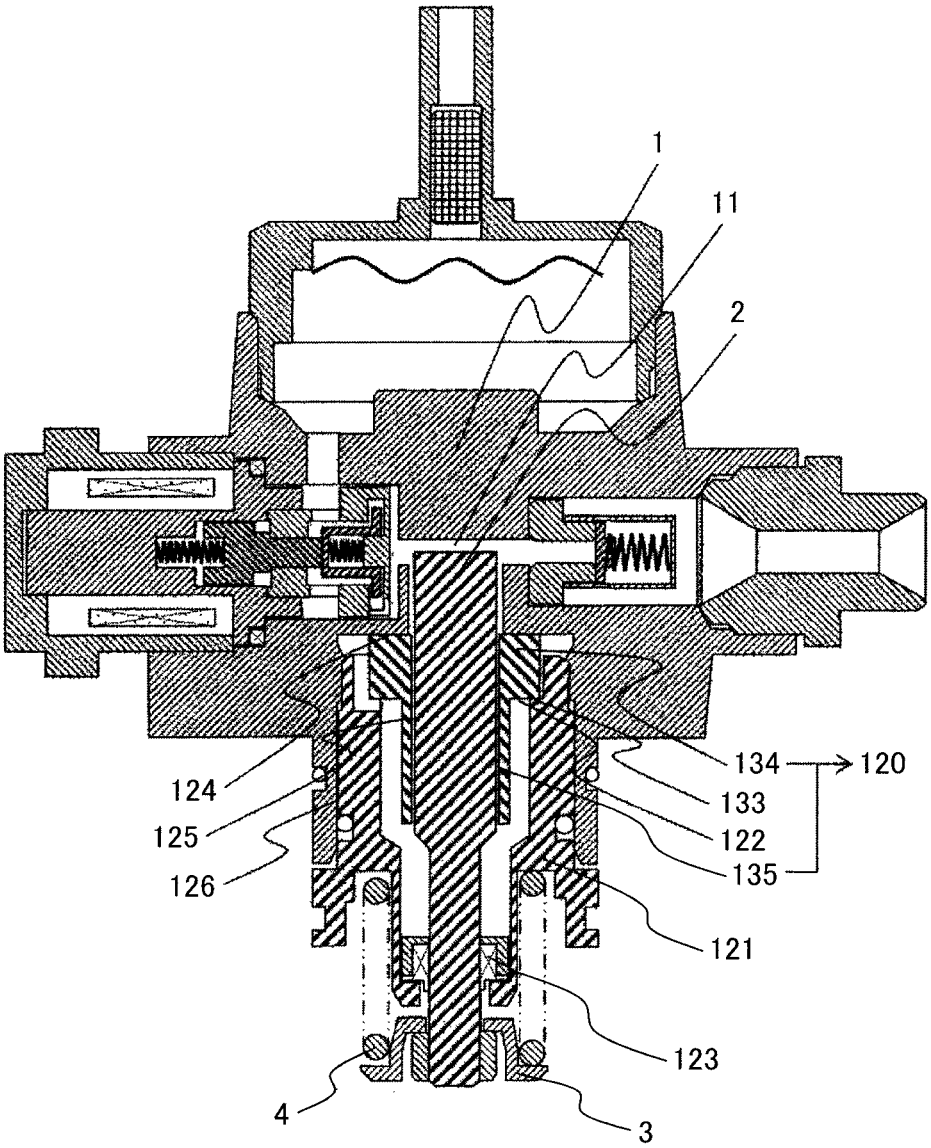
FIG. 3 shows a cross-sectional view of components around the cylinder (at top dead center) according to the second embodiment of the present invention.

FIG. 3 shows a cross-sectional view of components around the cylinder 120 according to the second embodiment of the present invention. FIG. 3 also shows the case where the plunger 2 is located at the top dead center. In FIG. 3, 1 represents a body, 2 a plunger, 120 a cylinder, 121 a holder member, 123 a sealing member, 4 a return spring, and 3 a retainer respectively. A small-diameter portion 135 and large-diameter portion 134 are provided in the cylinder 120, and the holding portion 133 is provided in the large-diameter portion 134. FIG. 3 shows, as an example, the case where the connecting portion between the small-diameter portion 135 and large-diameter portion 134 is formed by a stepped portion 122 having steps formed thereon. The holding portion 133, as in the first embodiment, is urged in the direction of the body 1 by a holder member 121 coupled to the body 1 by a coupling portion 126, and a high-pressure sealing portion 124 is formed in the contact portion between the body 1 and the cylinder 120. The cylinder 120 is provided with a sliding portion 125 on the low-pressure side of the high-pressure sealing portion 124, as in the first embodiment. By providing such a configuration, the holding portion 133 which receives the urging force can be thick for securing the strength, and the outer periphery of the sliding portion 125 on which fiction heat is generated by sliding can be thin for improving the heat dissipation. Further, when an external force in the radial direction acts on the plunger 2, the thick sliding portion 125 is deformed in the radial direction, and therefore the effect of reducing the generated surface pressure can be expected.

By setting the holding portion 133 to have a larger diameter and the sliding portion to have a smaller diameter, both improvement in heat dissipation and suppression of deformation can be achieved.

Figure 4:
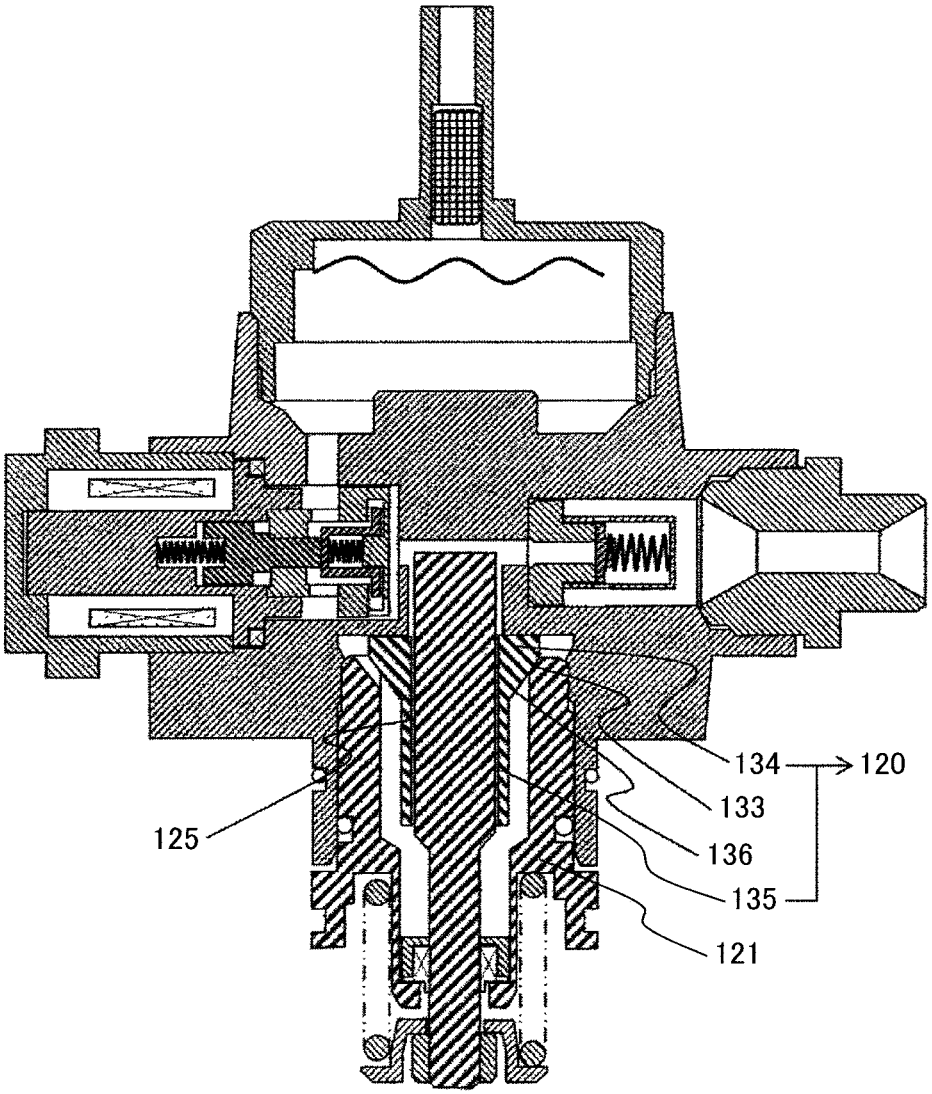
FIG. 4 shows a cross-sectional view of components around the cylinder (at top dead center) according to the second embodiment of the present invention.

The connecting portion between the small-diameter portion 135 and large-diameter portion 134 may be formed by a tapered portion 136 in a tapered shape as in FIG. 4, and a holding portion 133 may be formed on the tapered portion 136. As in the case of FIG. 3, the holding portion 133 is urged in the direction of the body 1 by the holder member 121. At this time, the tapered portion 136 is in contact with the holder member 121, so that the cylinder 120 is automatically aligned. Therefore, more accurate positioning can be realized, and improved reliability of the sliding portion 125 can be expected.

If the holding portion is tapered, the effect that the position of the cylinder is automatically aligned can be expected, and by realizing accurate positioning, unnecessary external force is not applied to the sliding portion.

Third Embodiment

Figure 5:
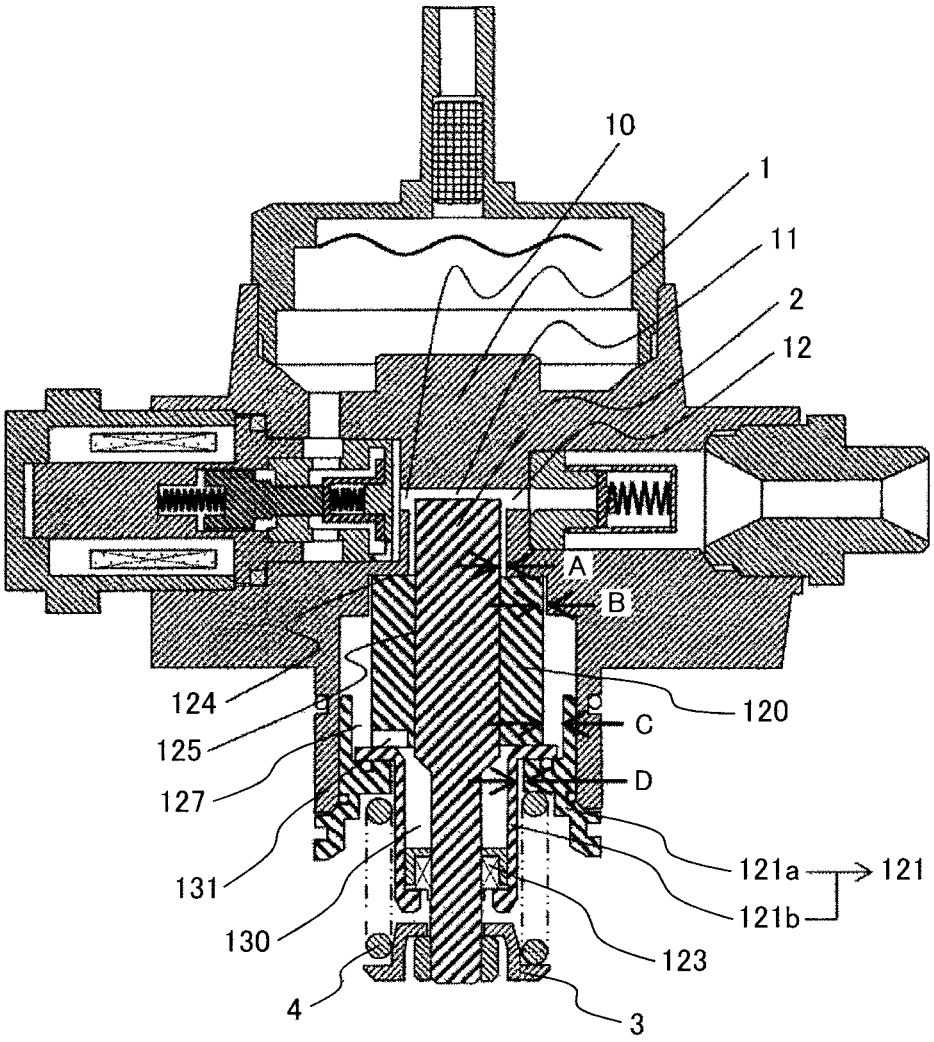
FIG. 5 shows a cross-sectional view of components around the cylinder (at top dead center) according to the third embodiment of the present invention.

FIG. 5 shows a cross-sectional view of components around the cylinder 120 according to the third embodiment of the present invention. FIG. 5 also shows the case where the plunger 2 is located at the top dead center. In FIG. 5, 1 represents a body, 2 a plunger, 120 a cylinder, 123 a sealing member, 4 a return spring, and 3 a retainer respectively.

In this embodiment, as in the first and second embodiments, a configuration in which the sliding portion 125 is not formed on the pressurizing chamber 11 side of the high-pressure sealing portion 124 is employed. By employing such a configuration, the cylinder 120 is prevented from entering the pressurizing chamber 11, and the pressurizing chamber 11 can be configured to have a cylindrical shape whose inner diameter is approximately the same as that of the outer diameter of the plunger 2. A minute gap with a width A is formed between the two components. By employing such an inner diameter shape of the pressurizing chamber 11 which fits the plunger 2, when the discharge pressure is increased to a high level, the precompression volume which can be a cause of reduction in the volumetric efficiency (the volume of the pressurizing chamber 11 when the plunger 2 is located at the top dead center) can be reduced.

Since the cylinder does not enter the pressurizing chamber, the pressurizing chamber can be formed in a cylindrical shape whose inner diameter is approximately the same as the outer diameter of the plunger, and the discharge passage and the suction passage can be arranged freely. Consequently, when the discharge pressure is increased to a high level, the precompression volume which can be a cause of reduction in the volumetric efficiency (the volume of the pressurizing chamber when the plunger is located at the top dead center) can be reduced.

In addition, by defining the dimensional relationship of the gaps formed between the members, the outer diameter of the cylinder can be highly precisely positioned by directly placing the same to the body, and the gaps in the pressurizing chamber can be further reduced. Thus, it is possible to further reduce the precompression volume.

This configuration also employs such a positional relationship that the positions in height (in the axial direction of the plunger 2) of the suction passage 10 and the discharge passage 12 relative to the plunger 2 coincide with the apex of the plunger 2 at the top dead center. Accordingly, the suction passage 10 and discharge passage 12 are not interrupted by the reciprocating movement of the plunger 2, which allows smooth suction and discharge of the fuel.

In addition, a minute gap with a width B is formed between the outer periphery of the cylinder 120 and the inner periphery of the body 1, and the dimensional relationship of the width A and the width B is A>B. Accordingly, since the outer periphery of the cylinder 120 and the inner periphery of the body 1 are in direct contact with each other during the assembly of the cylinder 120, positioning with higher accuracy can be realized compared to the case of positioning through the holder member 121, and the outer diameter of the plunger 2 and the inner diameter of the pressure chamber 11 can be more approximated to each other. Further, a gap with a width C is formed between the outer periphery of the cylinder 120 and the inner periphery of the holder member 121, and the dimensional relationship between the width B and the width C is C>B. Accordingly, the outer periphery of the cylinder 120 and the inner periphery of the holder member 121 are kept out of contact, and unnecessary external force does not act on the cylinder 120.

The holder member 121 is formed by two members: an urging member 121*a* and a seal holder member 121*b*. The seal holder member 121*b* is fitted to the urging member 121*a*, and a gap with a width D is formed between the two members. At this time, the dimensional relationship between the width B and the width D is preferably D>B. Accordingly, the position of the seal holder member 121*b* in the radial direction aligns with that of the plunger 2 via the sealing member 123, and therefore the axes of the two members coincide with each other, so that unnecessary external force does not act on the plunger 2. In addition, when the holder member 121 is formed of two members, from the perspective of securing a space, a fuel passage slit 131 which connects a main low-pressure fuel portion 130 and a secondary low-pressure fuel portion 127 may be formed on the cylinder 120 side.

Figure 6:
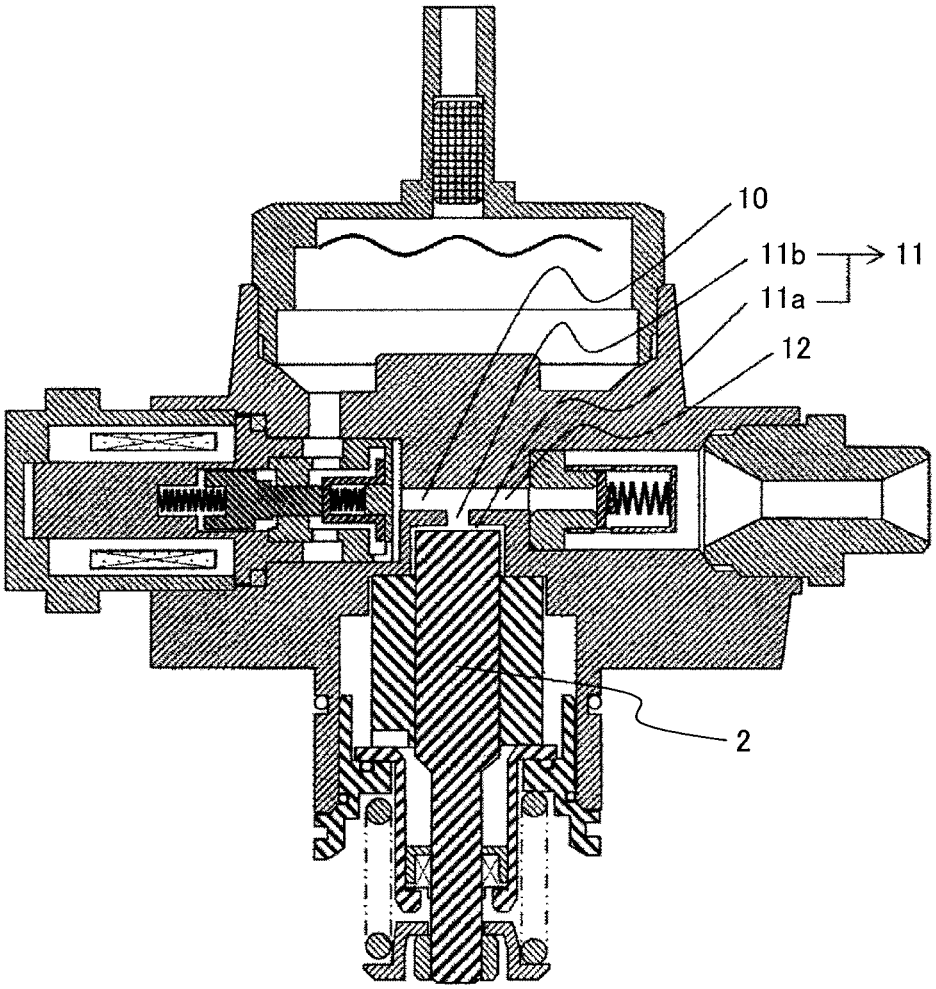
FIG. 6 shows a cross-sectional view of components around the cylinder (at top dead center) according to the third embodiment of the present invention.

Further, FIG. 6 shows a variation of FIG. 5. FIG. 6 shows the case where the plunger 2 is located at the top dead center. The pressurizing chamber 11 is formed by a capacity portion 11*a* where the plunger 2 reciprocates, and a passage portion 11*b* which connects the capacity portion 11*a* to the suction passage 10 and discharge passage 12. The inner diameter portion of the capacity portion 11*a* is formed in a cylindrical shape whose inner diameter is approximately the same as the outer diameter of the plunger 2. Also with this configuration, the same effects as in FIG. 5 can be achieved.

In conclusion, according to the present embodiment, a pump for supplying high-pressure fuel capable of improving reliability of the sliding portion at high pressures by reducing unnecessary external force acting on the sliding portion 125, and further capable of preventing reduction in the volumetric efficiency can be realized with a small-sized and simple structure.

By using the structure according to the embodiments of the present invention, a pump for supplying high-pressure fuel capable of improving reliability of the sliding portion at high pressures and further preventing a reduction of the volumetric efficiency can be realized with a small-sized and simple structure.

INDUSTRIAL APPLICABILITY

The present invention can be applied not only to pumps for supplying high-pressure fuel in internal combustion engines but also widely to various high-pressure pumps.

REFERENCE SIGNS LIST

1 . . . Body, 2 . . . plunger, 3 . . . retainer, 4 . . . return spring, 5 . . . electromagnetic valve, 6 . . . tappet, 7 . . . cam, 8 . . . discharge valve, 9 . . . low-pressure passage, 10 . . . fuel suction passage, 11 . . . pressurizing chamber, 11*a* . . . capacity portion, 11*b* . . . passage portion, 12 . . . fuel discharge passage, 20 . . . cylinder head, 40 . . . ECU, 50 . . . fuel tank, 51 . . . damper chamber, 53 . . . common rail, 54 . . . injector, 56 . . . pressure sensor, 120 . . . cylinder, 121 . . . holder member, 121*a* . . . urging member, 121*b* . . . seal holder member, 124 . . . high-pressure sealing portion, 125 . . . sliding portion, 126 . . . coupling portion, 127 . . . secondary low-pressure fuel portion, 128 . . . large-diameter portion, 129 . . . small-diameter portion, 130 . . . main low-pressure fuel portion, 131 . . . fuel passage slit 132 . . . low-pressure fuel portion, 133 . . . holding portion, 500 . . . electromagnetic coil, 501 . . . valve body, 502 . . . anchor spring, 503 . . . anchor, 504 . . . valve body spring.

The invention claimed is:

1. A pump for supplying high-pressure fuel comprising:

a plunger which pressurizes fuel in a pressurizing chamber;

a cylinder which guides the reciprocating movement of the plunger on an inner peripheral side face of the cylinder;

a body in which the cylinder is arranged; and a holder that is disposed between the cylinder and the body, wherein the cylinder has an uppermost end surface that is pressed against the body and which opposes the body, and wherein the entire cylinder is disposed on the side opposite to the pressurizing chamber relative to the uppermost end surface, the uppermost end surface of the cylinder is the only surface of the cylinder that directly contacts the body of the pump, a radially outwardmost side of the cylinder has a shape that is complementary with a shape of the holder at a given region, along a longitudinal direction of a low fuel-pressure portion of the pump, the given region is located in an upper half of the low fuel-pressure portion, and the uppermost end surface of the cylinder is an end of the cylinder that is closest to the pressurizing chamber, a first gap formed between the outer periphery of the cylinder and the body in the radial direction is smaller than a second gap formed in the radial direction between the inner diameter of the pressurizing chamber and the outer diameter of the plunger, a radial gap is formed in an entire area of the cylinder in an axial direction thereof between the cylinder and the body, the first gap is smaller than the second gap, and a portion of the body projects radially inward so as to directly overlap a first end of the plunger, the first end of the plunger being an axial end with a largest diameter.

2. The pump for supplying high-pressure fuel according to claim 1, wherein a sealing portion is formed by pressing the end of the cylinder at a location adjacent to the pressurizing chamber against the body.

3. The pump for supplying high-pressure fuel according to claim 1, wherein a large-diameter portion and a small-diameter portion are provided in the cylinder, wherein the large-diameter portion is disposed closer to the pressurizing chamber than the small-diameter portion, and wherein the large-diameter portion comes into contact with the body.

4. The pump for supplying high-pressure fuel according to claim 1, wherein a wall surface forming the low-pressure fuel portion includes both of part of the cylinder and part of the plunger.

5. The pump for supplying high-pressure fuel according to claim 1, wherein the pressurizing chamber whose volume increases and decreases with the reciprocating movement of the plunger is formed in the body, and wherein the pressurizing chamber is formed in a cylindrical shape having an inner diameter which slightly larger than the outer diameter of the plunger.

6. The pump for supplying high-pressure fuel according to claim 5, wherein a suction passage which sucks fuel into the pressurizing chamber and a discharge passage which discharges fuel from the pressurizing chamber are formed, and wherein the position in the axial direction of the suction passage or the discharge passage relative to the plunger coincides with the apex of the plunger at the top dead point, or is located in the direction of elevation of the plunger from the apex.

7. The pump for supplying high-pressure fuel according to claim 1, wherein the first gap is smaller than a third gap formed in the radial direction between the outer periphery of the cylinder and the inner periphery of the holder.

8. The pump for supplying high-pressure fuel according to claim 1, wherein the holder is composed of two members: a seal holder member having a sealing member therein for sealing low-pressure fuel, and an urging member for urging the cylinder to the body, and wherein the seal holder member is fitted to the urging member, and a fourth gap is formed in the radial direction between the two members.

9. A pump for supplying high-pressure fuel comprising:

a plunger which pressurizes fuel in a pressurizing chamber;

a cylinder which guides the reciprocating movement of the plunger on an inner peripheral side face of the cylinder;

a body in which the cylinder is arranged;

a holder that is disposed between the cylinder and the body configured to fix the cylinder to the body, wherein the cylinder is inserted from a lower part of the body and is biased upward in the axial direction by the holder so that an upper end surface of the cylinder that is adjacent to the pressurizing chamber is pressed against the body; and the upper end surface forms a seal that seals a space between the pressurizing chamber and a low-pressure fuel portion, wherein an entirety of the cylinder is disposed on a side that is opposite to the pressurizing chamber from the upper end surface, the upper end surface of the cylinder is flat from an inner end of the cylinder to an outer end of the cylinder, and a portion of the body projects radially inward so as to directly overlap a first end of the plunger, the first end of the plunger being an axial end with a largest diameter.

10. The pump for supplying high-pressure fuel according to claim 9, wherein a large-diameter portion and a small-diameter portion are provided in the cylinder, wherein the large-diameter portion is disposed closer to the pressurizing chamber than the small-diameter portion, and wherein the large-diameter portion comes into contact with the body.

11. The pump for supplying high-pressure fuel according to claim 10, wherein a connection portion between the large-diameter portion and the small-diameter portion forms a stepped portion in a stepped form, and receives an urging force in the axial direction by the stepped portion.

12. The pump for supplying high-pressure fuel according to claim 10, wherein a connection portion between the large-diameter portion and the small-diameter portion forms a tapered portion in a tapered form, and receives an urging force in the axial direction in the tapered portion.

13. The pump for supplying high-pressure fuel according to claim 9, wherein a wall surface forming the low-pressure fuel portion includes both of part of the cylinder and part of the plunger.

14. The pump for supplying high-pressure fuel according to claim 9, wherein the pressurizing chamber whose volume increases and decreases with the reciprocating movement of the plunger is formed in the body, and wherein the pressurizing chamber is formed in a cylindrical shape having an inner diameter which is approximately equal to the outer diameter of the plunger.

15. The pump for supplying high-pressure fuel according to claim 14, wherein a suction passage which sucks fuel into the pressurizing chamber and a discharge passage which discharges fuel from the pressurizing chamber are formed, and wherein the position in the axial direction of the suction passage or the discharge passage relative to the plunger coincides with the apex of the plunger at the top dead point, or is located in the direction of elevation of the plunger from the apex.

16. The pump for supplying high-pressure fuel according to claim 9, wherein a first gap formed between the outer periphery of the cylinder and the body in the radial direction is smaller than a second gap formed in the radial direction between the inner diameter of the pressurizing chamber and the outer diameter of the plunger.

* * * * *